US005127619A

United States Patent [19]

Bleim

[11] Patent Number: 5,127,619

[45] Date of Patent: Jul. 7, 1992

[54] PLASTIC COIL SEPARATOR

[76] Inventor: Roger A. Bleim, 2957 N. Island Cir., Port Clinton, Ohio 43452

[21] Appl. No.: 367,351

[22] Filed: Jun. 16, 1989

[51] Int. Cl.[5] ..... B65D 19/00

[52] U.S. Cl. ..... 248/346; 248/909; 108/51.1

[58] Field of Search ..... 248/346, 909; 108/51.1-51.3, 52.1, 53.1

[56] References Cited

U.S. PATENT DOCUMENTS

| | | | |
|---|---|---|---|
| 2,446,914 | 8/1948 | Fallert et al. | 108/51.3 |
| 2,685,398 | 8/1954 | King | 108/51.3 X |
| 2,916,159 | 12/1959 | O'Neill | 248/909 X |
| 3,567,068 | 3/1971 | Carfizzi | 108/51.1 X |
| 3,759,193 | 9/1973 | Branch | 108/51.1 |
| 3,814,778 | 6/1974 | Hosoda et al. . | |
| 3,832,955 | 9/1974 | Pottinger et al. . | |
| 3,911,182 | 10/1975 | Liberman . | |
| 4,116,344 | 9/1978 | Ziemba . | |
| 4,386,704 | 6/1983 | Maillet . | |
| 4,579,320 | 4/1986 | Gladish | 108/51.1 X |
| 4,714,026 | 12/1987 | Yamaguchi et al. . | |
| 4,789,046 | 12/1988 | McDowall . | |
| 4,838,169 | 6/1989 | Gladish . | |

FOREIGN PATENT DOCUMENTS 2088619 7/1972 France .

*Primary Examiner*—Alvin C. Chin-Shue

*Attorney, Agent, or Firm*—Emch, Schaffer, Schaub & Porcello Co.

[57] ABSTRACT

Plastic coil separators provide an improved storage environment for coils of strip steel and the like. The coil separators are fabricated of a rigid plastic such as polyvinyl chloride (PVC), acrylonitrile butadiene styrene (ABS), polystyrene or similar thermoplastic materials. The separators are elongate and hollow, having one or two axially extending passageways. Transverse kerfs extending substantially through the walls of the separator at regular, spaced-apart intervals facilitate fracture of the elongate separators into desired, shorter lengths for use.

16 Claims, 1 Drawing Sheet

PLASTIC COIL SEPARATOR

BACKGROUND OF THE INVENTION

The invention relates generally to separators for coiled metal stock and more specifically to a hollow plastic coil separator having transverse kerfs.

Punch presses and similar fabricating equipment commonly utilize steel or other material in the form of indeterminate length strips which are advanced through the machine to fabricate a specific product. For transport and storage, such strips are generally rolled into coils having a thickness equal to the width of the strip and a diameter of from a few to several feet. The coil is secured by shipping straps and provides a compact, secure package.

In shipment and in storage, such coils are generally arranged in stacks and separated by radially disposed spacers. Such spacers not only permit air circulation through the stack of coils, thereby minimizing oxidation and effects associated with high humidity and condensation, but also facilitate engagement of a coil or coils by the forks of a fork lift truck.

It has been known to utilize wood or paper separators but these types of separators have certain disadvantages which render them less than desirable in such service. Both wood and compressed paper spacers are hygroscopic. Moisture absorbed in these spacers may cause increased oxidation of the coil surfaces in contact therewith.

Secondly, spacers of both materials, particularly those of pressed paper and similar cellulosic wood byproducts, are compressible. With time, such compression results in decreased air circulation within the stack of coils and also renders fork lift engagement more difficult.

Such separators, particularly those fabricated of paper of compressed wood fibers, shed material in the form of dust and particulates. While this problem can be merely a nuisance, it can also require additional cleaning of material and manufacturing areas.

Since the wood or compressed paper separators are essentially a one-way product, that is, they travel from the fabricator of the strip coils to the user of such coils, the user becomes an unwilling collector of such spacers. Typically, they are simply discarded but the volume of waste they represent over a period of time can be substantial.

In view of the foregoing, it is apparent that improvements to coil separators are both desirable and possible.

SUMMARY OF THE INVENTION

Plastic coil separators according to the instant invention provide an improved storage environment for coils of strip steel and the like. The coil separators are fabricated of a rigid plastic such as polyvinyl chloride (PVC), acrylonitrile butadiene styrene (ABS), polystyrene or similar thermoplastic materials. These materials exhibit excellent strength, good dimensional stability and are substantially non-hygroscopic. The selected plastic preferably has a D Scale Durometer hardness of between 68 and 75. The separators are elongate and hollow, having one or two internal, axially extending through passageways. In cross section, the passageways preferably define shapes smaller than but the same configuration as the periphery of the separator. Transverse kerfs extending substantially through the walls of the separator at regular, spaced-apart intervals facilitate fracture of the elongate separators into desired, shorter lengths for use. The separators are most readily and conveniently manufactured by extrusion processes.

Because the coil separators are fabricated of plastic, they may be readily recycled, melted down and formed into new coil separators.

Thus it is an object of the instant invention to provide a coil separator of plastic having good dimensional stability and resistance to water absorption.

It is a further object of the present invention to provide a plastic coil separator fabricated in an elongate hollow configuration having one or two internal passageways.

It is a still further object of the present invention to provide a plastic coil separator fabricated in an elongate and hollow configuration having a kerf extending substantially therethrough which facilitates fracturing the elongate structure into desired lengths for use.

Further objects and advantages of the present invention will become apparent by reference to the appended drawings and the following Description of the Preferred and Alternate Embodiments.

DESCRIPTION OF THE PREFERRED AND ALTERNATE EMBODIMENTS

Figure 1:
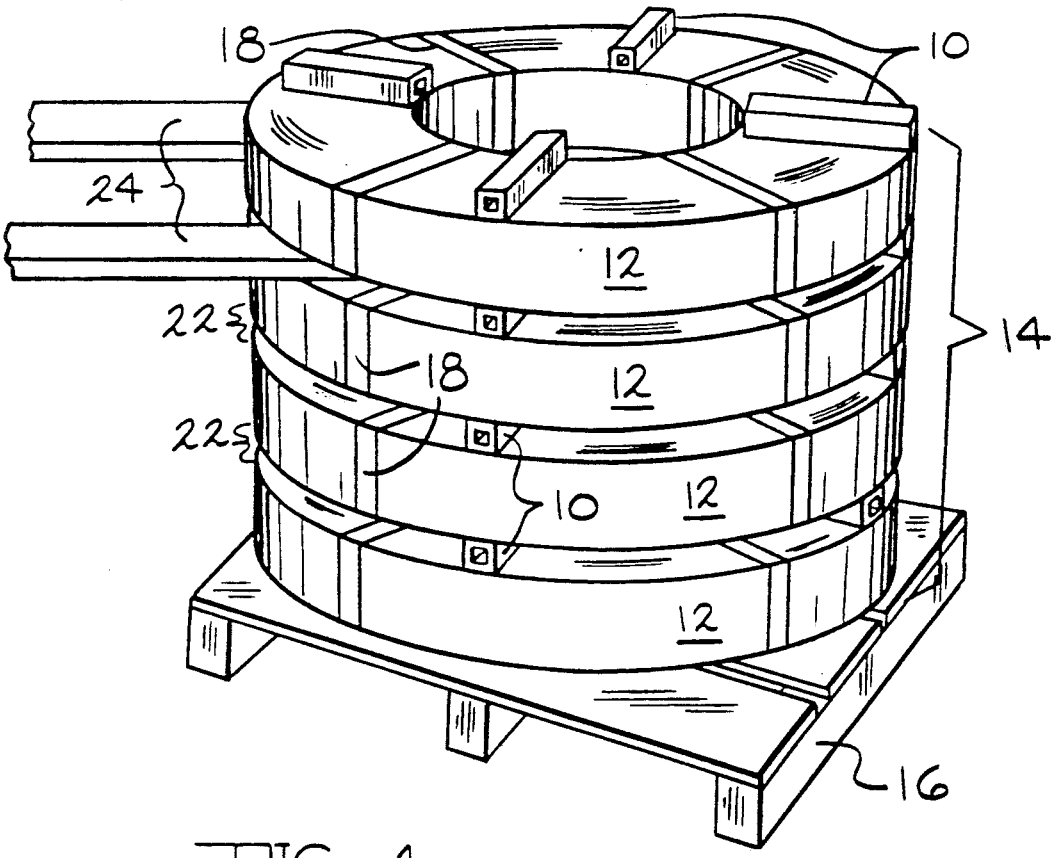
FIG. 1 is a perspective view of a stack of steel coils disposed on a pallet and separated by coil separators according to the present invention.

Referring now to FIG. 1, preferred embodiment coil separators according to the present invention are illustrated and generally designated by the reference numeral 10. The coil separators 10 are illustrated disposed in groupings of four between each coil 12 of a stack 14 of coils 12 of strip steel or similar material disposed upon a pallet 16 or like structure. The coils 12 are maintained in their rolled, circular configuration by straps 18. The separators 10 provide vertical intervals 22 between adjacent coils 12 substantially equal to their height which facilitate circulation of air around and through the coils 12 of a stack 14 thereby minimizing problems of moisture condensation and attendant oxidation particularly if the material from which the coils 12 are fabricated is steel or a similar ferrous material prone to oxidation. Intervals 22 provided by the separators 10 also facilitate engagement of a coil or coils 12 by the forks 24 of a fork lift truck or similar device (not illustrated).

Figure 2:
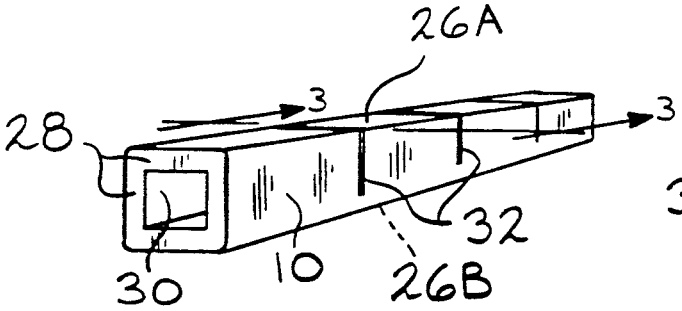
FIG. 2 is a perspective view of a hollow, square coil separator according to the present invention.
Figure 3:
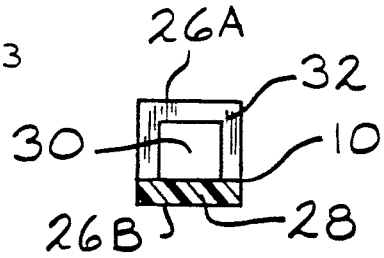
FIG. 3 is a full, sectional view of a square coil separator according to the present invention taken along line 3—3 of FIG. 2.

Turning to FIGS. 2 and 3, the coil separator 10 of the preferred embodiment is illustrated. The coil separator 10 is a bar preferably substantially square in cross section which defines substantially flat and parallel upper and lower surfaces 26A and 26B, respectively, and includes substantially equal thickness walls 28. The walls 28 define a substantially centrally located square, central passageway 30 which extends axially the length of the separator 10. The thickness of each of the walls 28 is preferably about 20% of the width of the cross section. Accordingly, the width (or height) of the central passageway 30 is preferably about 60% of the total width (or height) of the separator 10.

To ensure suitable strength, the thickness of the walls 28 is preferably not less than about 15% of the total width of the separator 10 and need not be more than about 30% of the total width (or height) of the separator 10. Accordingly, the width (or height) of the central passageway 30 may vary from approximately 40% to 70% of the total width (or height) of the separator 10. Typically, the width (or height) of the coil separator 10 according to the present invention will be between 0.75 and 1.00 inches, though for special applications it is anticipated that this dimension may vary between 0.5 inches and 1.5 inches or lesser or greater if desired.

By way of example and illustration and not by way of limitation, if it is assumed that the coil separator 10 according to the present invention is one inch square in cross section, the wall thickness is preferably about 0.20 inches and the central passageway 30 is preferably about 0.60 inches. The wall thickness, however, may vary from about 0.15 inches to about 0.30 inches and the central passageway 30 may thus vary correspondingly from about 0.70 inches to about 0.40 inches.

While typically fabricated in indefinite lengths, it has been found desirable to provide the separators in four foot lengths. At suitable intervals, preferably about every 6 inches, a channel or kerf 32 is disposed through three walls 28 of the coil separator 10 as illustrated in FIG. 3. The kerf 32 provides a fracture site which facilitates breaking an elongate coil separator 10 according to the present invention into shorter lengths. The kerfs 32 may be disposed more closely together, for example, at 3 inch intervals, if very accurate lengths of the coil separators 10 are desired or at intervals of greater lengths, for example, 12 inches, if it is anticipated that only longer or less accurately sized lengths of the coil separators 10 will be required.

It has been found that sizing the kerf 32 such that it extends through three of the walls 28 but leaves the fourth intact is the optimum configuration to facilitate fracture of the coil separators 10 while still providing suitable and appropriate strength to the unbroken coil separators 10. A shallower kerf 32 which contemplates removal of less material rapidly changes the fracture structure from a simple rectangular cross section into a U-section of increasing depth which begins to exhibit channel beam and eventually box beam strength, rendering fracture difficult. A deeper kerf 32 which contemplates removal of more material simply begins to lessen the structural integrity of the coil separator 10, as will be readily appreciated.

The coil separator 10 is preferably fabricated by conventional extrusion processes of thermoplastic materials such as polyvinyl chloride (PVC), acrylonitrile butadiene styrene (ABS), polystyrene or similar thermoplastic materials. The composition of such plastics is preferably such that they exhibit D Scale Durometer hardness of between about 68 and 75 at typical ambient temperatures.

Figure 4:
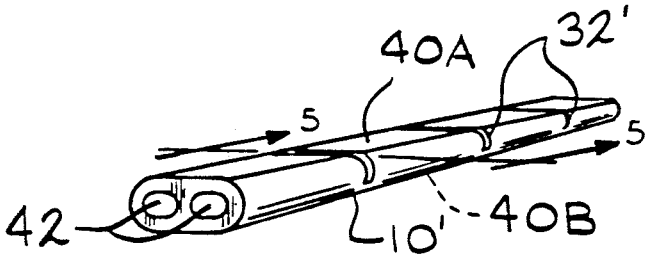
FIG. 4 is a perspective view of a hollow, oval coil separator according to the present invention.
Figure 5:
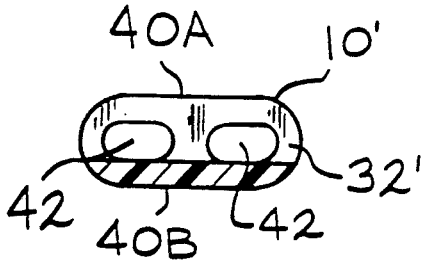
FIG. 5 is a full, sectional view of an oval coil separator according to the present invention taken along line 5—5 of FIG. 4.

Referring now to FIGS. 4 and 5, a first alternate embodiment coil separator 10' is illustrated. The first alternate embodiment coil separator 10' is generally oval in cross section, having substantially flat and parallel upper and lower surfaces 40A and 40B, respectively. The first alternate embodiment coil separator 10' has a height to width ratio of 0.5 to 1.00. The height and width of the first alternate embodiment coil separator 10' preferably varies from about 0.375 by 0.75 inches to about 1.00 inches by 2.00 inches. Extending axially through the alternate embodiment coil separator 10' are a pair of parallel, through passageways 42. The height and width of the passageways 42 are preferably about one-third, that is, 33%, the height and width, respectively, of the alternate embodiment coil separator 10'. Ideally, the height and width of the passageways are not less than about 25% the corresponding height and width of the coil separator and preferably no more than about 40% the corresponding height and width. The first alternate embodiment 10' may also be rectangular in cross section with rectangular passageways 42, if desired.

By way of example and illustration and not by way of limitation, the height and width of the first alternate embodiment coil separator 10' may be 0.50 inches and 1.00 inches, respectively and thus the height and width of one of the passageways 42 will be preferably about 0.17 inches by 0.33 inches, respectively.

The alternate embodiment coil separators 10' are also preferably provided in four foot lengths. At spaced-apart intervals along the length of the first alternate embodiment coil separator 10' are disposed kerfs 32' which function as fracture sites for breaking elongate coil separators 10' into shorter lengths as described above with regard to the preferred embodiment coil separator 10'.

The alternate embodiment coil separators 10' are preferably fabricated of the same materials delineated above with regard to the preferred embodiment coil separator 10.

It will be appreciated that coil separators 10 and 10' fabricated according to the present invention provide an improved means of separating and rigidly supporting individual coils 12 in a stack 14 of such coils. Specifically, the separators 10 and 10' are non-hygroscopic. They are also dimensionally stable and exhibit little compression, i.e., cold flow, such as exhibited by prior art separators. Furthermore, the plastic material is for all practical purposes dust and contamination free which provides a cleaner product to the user of the coils 12 in which such separators 10 and 10' are placed. Finally, the coil separators 10 and 10' according to the present invention are recycleable. That is, they may be returned to the fabricator, melted down and remanufactured by extrusion or similar fabrication means into products exhibiting all the characteristics of the new coil separators.

The foregoing disclosure is the best mode devised by the inventor for practicing this invention. It is apparent, however, that products incorporating modifications and variations will be obvious to one skilled in the art of coil separators. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. A coil separator for spacing stock comprising, in combination, an elongate non-hygroscopic plastic bar having substantially flat and planar upper and lower surfaces and walls defining at least one through axial passageway, and at least one kerf disposed transversely in said plastic bar and extending substantially through all but one of said walls.

2. The separator of claim 1 wherein said bar is fabricated of a plastic selected from the group consisting of polyvinyl chloride, acrylonitrile butadiene styrene or polystyrene.

3. The separator of claim 1 wherein said bar and said passageway are square and/or rectangular in cross section.

4. The separator of claim 1 wherein said bar and said passageway are oval in cross section.

5. The separator of claim 1 wherein said passageway has a cross section smaller than but of substantially the same shape as the periphery of said bar.

6. The separator of claim 1 wherein said plastic bar has a D Scale Durometer hardness of between about 68 and 75.

7. The separator of claim 1 wherein said bar defines two axially extending passageways and said bar and said passageways are oval in cross section.

8. The separator of claim 1 further including a plurality of kerfs disposed along said plastic bar.

9. A coil separator for spacing coils of stock, comprising, in combination, an elongate, non-hygroscopic plastic bar having substantially flat and planar upper and lower surfaces and walls defining at least one axxially extending passageway, and at least one kerf disposed transversely in said plastic bar and extending from one wall substantially through said passageway.

10. The coil separator of claim 9 wherein said bar is fabricated of a plastic selected from the group consisting of polyvinyl chloride, acrylonitrile butadiene styrene or polystyrene.

11. The coil separator of claim 9 wherein said bar and said passageway are square in cross section.

12. The coil separator of claim 9 wherein said bar and said passageway are oval in cross section.

13. The coil separator of claim 9 wherein said bar defines two axially extending passageways and said bar and said passageways are oval in cross section.

14. The coil separator of claim 9 further including a plurality of kerfs disposed along said plastic bar.

15. A coil separator for spacing coils of stock comprising, in combination, an elongate non-hygroscopic bar fabricated of a plastic selected from the group consisting of polyvinyl chloride, acrylonitrile butadiene styrene or polystyrene, having substantially flat and planar upper and lower surfaces and walls defining at least one axially extending passageway said passageways having a cross section corresponding in shape to the cross section of said bar, said bar having a D Scale Durometer hardness of between 68 and 75, and at least one kerf disposed transversely in said plastic bar and extending substantially through all but one of said walls.

16. The coil separator of claim 15 wherein the height and width of said passageway is between about 25% and 60% of the height and width, respectively, of said bar.

* * * * *